United States Patent [19]

Andresen

[11] 4,332,177

[45] Jun. 1, 1982

[54] CONTROL SYSTEM HAVING SQUEEZE TYPE MANUAL ACTUATOR

[76] Inventor: Herman J. Andresen, 712 Carriage Hill, Glenview, Ill. 60025

[21] Appl. No.: 154,802

[22] Filed: May 30, 1980

[51] Int. Cl.[3] ..... G05G 9/04; H01C 10/00

[52] U.S. Cl. ..... 74/491; 74/109; 74/471 R; 74/471 XY; 74/483 PB; 74/523; 338/78

[58] Field of Search ..... 74/89.17, 109, 471 R, 74/471 XY, 483 PB, 491, 523; 180/333; 244/234; 338/68, 78

[56] References Cited

U.S. PATENT DOCUMENTS

| | | | |
|---|---|---|---|
| 1,614,777 | 1/1927 | Dellagala | 74/109 |
| 3,131,795 | 5/1964 | Shimanckas | 74/483 PB |
| 3,233,472 | 2/1966 | Canalizo et al. | 74/132 X |
| 3,701,288 | 10/1972 | Jordan | 74/471 XY |
| 4,062,508 | 12/1977 | Stephens | 74/491 X |

*Primary Examiner*—Allan D. Herrmann

*Attorney, Agent, or Firm*—Leydig, Voit, Osann, Mayer & Holt, Ltd.

[57] ABSTRACT

A squeeze type manual actuator including a control arm with a pair of hand grips extending from the upper end of the arm, at least one of the hand grips being mounted on the arm for movement toward and away from the other hand grips. The hand grips are provided with gripping pads and have a normal spacing in which the pads are respectively engageable by the palm and finger tips of one hand of the operator. The movable hand grip engages a plunger having a return spring. A signal producing device is coupled to the plunger for producing an output signal of pre-selected polarity and which varies in accordance with plunger displacement. In the preferred embodiment of the invention the arm has upper and lower sections with limited lost motion between them in opposite directions from a neutral position. The polarity is pre-selected in accordance with the direction of relative movement between the sections so that by moving the hand grips in a direction to take up lost motion an output signal of desired polarity is produced upon subsequent squeezing together of the hand grips. The arm is hinged at its lower end and a second signal-producing means produces a second output signal in accordance with the rocking movement of the arm, thereby enabling simultaneous independent control of multiple functions. In an alternate embodiment a double-throw switch is used for polarity selection, the switch being mechanically interlocked to prevent throwing between its alternate states when the hand grips are in squeezed condition.

29 Claims, 20 Drawing Figures

1ST OUTPUT SIG. (O)
2ND. OUTPUT SIGNAL

CONTROL SYSTEM HAVING SQUEEZE TYPE MANUAL ACTUATOR

In controlling complicated machinery such as excavators, cranes, man lifts, special automotive vehicles and the like, efficient operation calls for coordinated control of two or more variables at the same time. For example in the control of an excavating shovel it is desirable to be able to control both the angle and degree of extension of the shovel arm, both in the forward and reverse directions, to guide the shovel along a predetermined digging path. Similarly, in the case of a crane it is desirable to be able to raise and lower the boom while swinging the boom left and right. Control of multiple, and particularly coordinated functions has, in the past, most often been accomplished by using two hands and, where necessary, the feet. Thus the operator of a large earth moving shovel, for example, must engage in highly skilled acrobatics.

Also, in certain cases such as positioning a structural member on a construction project, exact placement requires jogging the crane boom or cable up or down in a "hunting" maneuver because of the difficulty in causing small position changes to be made smoothly and precisely with the common hand lever as a controller, which, in fact, is controlled by arm motions. The muscles of the hand are better adapted to the control of slowly applied and released light forces and to starting and stopping motions in small increments than the larger muscles of the arm, thus making a hand grip or squeeze a preferable means of exercising precision control than an arm motion.

It has been proposed in the past to employ manual squeezing to achieve a control function. An example of such control is that which is used to control the speed of a "slot car". However, such controls have been limited to a control signal of single polarity whereas for most control purposes it is desirable to control both polarity and magnitude in a single direction of squeeze.

It is, accordingly, an object of the present invention to provide a control system including a squeeze type manual controller permitting convenient control of the polarity and magnitude of a control function. By squeezing type controller, as such term is applied to the devices disclosed herein, is meant a controller in which manual squeezing results in sensible motion with a simultaneous and generally proportional increase in reaction force. It is a related object to provide a composite controller which is ideally suited to the simultaneous control of both magnitude and polarity of two or more functions by the same hand of the operator.

It is another object to provide a manual squeeze type controller in which means are provided for pre-selection of the polarity at the output signal so as to achieve a full degree of control. It is a more specific object of the invention to provide a manual controller utilizing squeeze with pre-selection of signal polarity and in which such pre-selection is achieved by an auxiliary movement of the hand of the operator. Such auxiliary movement may, for example, be a slight forward or backward rocking or slight rocking from one side to the other, or slight downward movement before actual squeezing of the control takes place, all of these being natural movements quickly and easily mastered. Or such pre-selection may be achieved electrically by means of a digitally operated switch. It is another specific object to provide, in a control of the above type an interlock arrangement requiring that the squeezing force be completely released, that is, that the magnitude of the output signal be reduced to zero level, before the polarity of the output signal can be changed thereby precluding damagingly abrupt changes of signal even in the hands of a careless operator.

It is still another object to provide a controller capable of highly sensitive and precise control and which is particularly suited to use under adverse, stressful or "bumpy" conditions as, for example, on a vehicle such as a military tank, earth-moving machine or speed boat.

It is a related object of the invention to provide a controller which is ideally suited for the simultaneous control of a first function requiring high precision and a second function requiring less precision, with the first function being controlled by squeezing a pair of hand grips together and the second function being controlled by bodily rocking movement of the arm upon which the hand grips are mounted.

It is yet another object of the invention to provide a manual control which is highly versatile and which may be adapted for use in controlling functions in many fields of endeavor. In this connection it is an object to provide a manual controller which may be integrated into any type of control system, whether it be mechanical, electrical or hydraulic with only minor modification.

Other objects and advantages of the invention will become apparent upon reading the attached detailed description and upon reference to the drawings in which.

Figures 1, 2, 3:
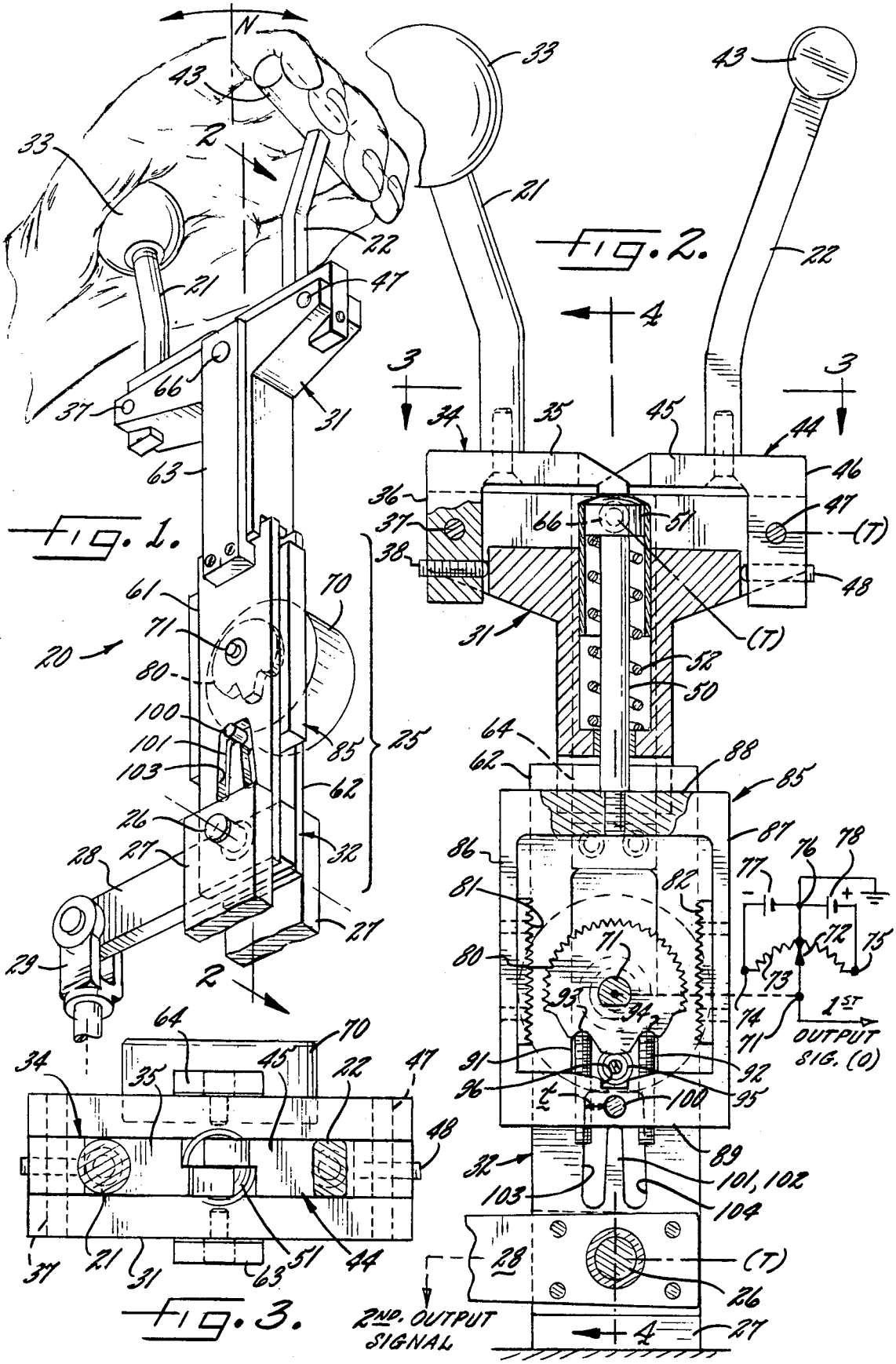
FIG. 1 is a perspective view of a controller constructed in accordance with the invention.
FIG. 2 is a sectional elevation of the controller of FIG. 1 taken along the line 2—2 in latter figure.
FIG. 3 is a top view in partial section looking along line 3—3 in FIG. 2.
Figure 4:
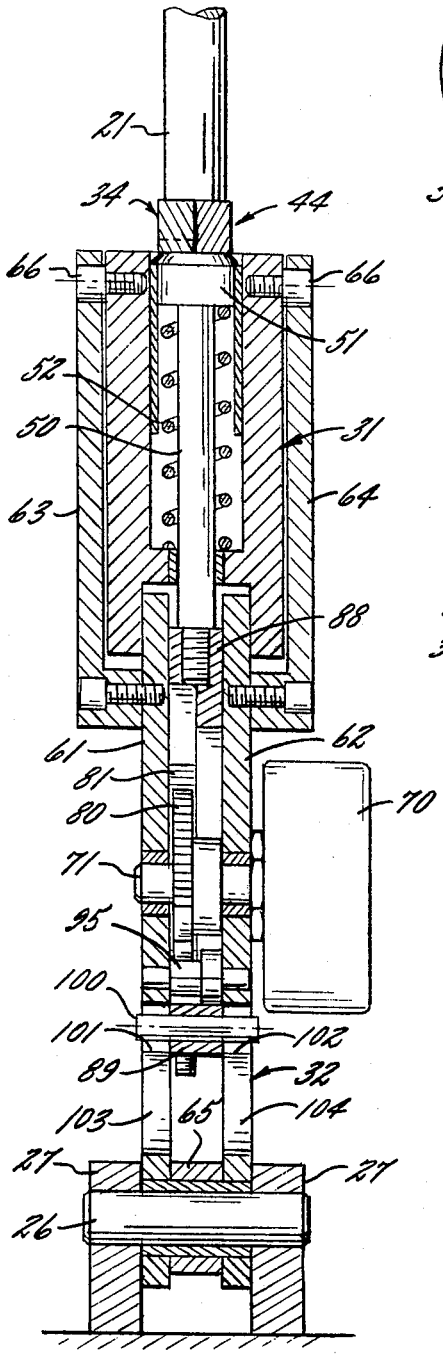
FIG. 4 is a transverse section, in elevation, taken along line 4—4 in FIG. 2.

While the invention has been described in connection with certain preferred embodiments, it will be understood that I do not intend to be limited by the particular embodiments shown but intend, on the contrary, to cover the various alternative and equivalent constructions included within the spirit and scope of the appended claims.

Turning now to the drawings, and particularly to FIGS. 1–4, there is shown a manual controller 20 constructed in accordance with the invention and which is particularly distinguished by a pair of hand grips 21, 22 in the form of levers which are manually squeezed together by the hand of the operator to produce an output signal. The signal produced by squeezing in the present embodiment is electrical, of pre-selected polarity and of variable magnitude, but it will be understood that in the practice of the invention the output signal may take other forms, particularly mechanical or hydraulic. While the primary control function is controlled by squeezing action, it is contemplated that a second control function may be simultaneously controlled by the bodily rocking movement of the arm on which the squeeze hand grips are mounted.

For the sake of easy understanding, attention may first be given to the control function performed by bodily swinging the arm.

The control arm, indicated by the numeral 25 has a lower, or main, hinge connection 26 by which it is pivoted to a mount 27 which may form part of the stationary frame structure. When the arm is rocked back and forth for control purposes, the aim is to produce an output signal which varies in polarity, that is, sense of direction, and also in magnitude. The polarity is determined by the direction of throw of the arm from the neutral position N (FIG. 1) and the magnitude of the signal is determined by the arc, measured from neutral, through which the arm is rocked. The simplest means for producing an output signal is a direct coupling including an output arm 28 which positions a control linkage, a portion of which has been indicated at 29. For a reason which will become clear it is important, in at least the first embodiment of the invention to be described, that the linkage 29 offer opposing force in both the push and pull directions, the level of opposing force usually present in a practical linkage system being sufficient in many cases.

In accordance with the present invention at least one of the hand hand grip 21, 22 is mounted on the arm for movement toward and away from the other hand grip, the movable lever being coupled to a motion-transmitting element in the form of a plunger having a return spring. Means are coupled to the plunger for producing an output signal of pre-selected polarity and which varies in accordance with plunger displacement. For the purpose of pre-selecting the priority, or sense, of the output signal, the arm is made of upper and lower sections having limited lost motion between them in opposite directions. The direction of relative movement between the sections, and the taking up of lost motion, is utilized to select the polarity of the output signal.

Thus, turning to FIGS. 1 and 2 the arm 25 will be seen to have an upper portion 31 and a lower portion 32. The upper portion is of "T" shaped profile, the hand grips 21, 22, in the preferred embodiment, being pinned to the projecting arms of the "T". Thus the hand grip 21, which has a palm rest 33 at its upper end, has a base 34 which is of "L" cross section having a horizontal portion 35 and a vertical portion 36, the latter being secured by a transversely extending pin 37 having an adjacent set screw 38 which determines the normal position of the lever.

Similarly the hand grip 22 has a finger grip 43 at its upper end and has a base 44 consisting of horizontal and vertical portions 45, 46, respectively, secured by a transversely extending pin 47 and an accompanying set screw 48 which serves as a positioner.

The palm rest 33 and finger grip 43 may take various forms and may be referred to by the general term "gripping pads", such term including any surfaces respectively engageable by two portions of the hand of the operator, with the hand in the normal grasping or squeezing position.

For the purpose of transmitting the relative movements of the hand grips 21, 22, a plunger 50 is reciprocally mounted within the upper portion 31 of the arm, the plunger having an end cap 51 at its upper end positioned in the path of vertical movement of the portions 35, 45 of the respective levers. Telescoped over the plunger 50 is a return spring 52 which provides a linear build-up of restoring force which assists the operator in sensing the degree of squeeze applied to the hand grips.

Prior to discussing how an output signal is derived from the position of the plunger 50, reference may be made to the manner in which the lower portion 32 of the arm is constructed. Such lower portion is formed, primarily, by a pair of side plates 61, 62 which are spaced from one another and which have respective suspension straps 63, 64 at the top and which are joined, at the bottom, by a spacer 65 which may, for example, consist of the inner end of the arm 28 previously referred to. The upper ends of the suspension straps 63, 64 are secured to the upper portion 31 of the arm at aligned pivots forming an auxiliary hinge joint 66. The auxiliary hinge, connecting the portions 31, 32 of the arm together, provides a limited amount of angular lost motion between the portions of the arm which is utilized in pre-selecting the polarity, or sense, of the squeeze output signal. However, before discussing the details of pre-selection, reference will be made to the general means for producing the output signal which, in the present instance, includes a potentiometer 70. Such potentiometer, as diagrammatically shown in FIG. 2, includes a frame journalling a shaft 71 having a wiper 72 which engages a resistance element 73 having end terminals 74, 75 and, in the illustrated embodiment, a central terminal 76. Sources of potential, polarized in the same direction, and which may be considered for simplicity to be in the form of batteries 77, 78, are connected across the respective halves of the resistance element. As a result, when the slider is in the illustrated central position, the voltage across output terminals 71, 76 is zero. Moving the slider in one direction causes an increase in positive output voltage while moving the slider in the opposite direction from its central, or neutral, position causes an increase of voltage in the negative direction. The invention also contemplates use of a "contactless" potentiometer as disclosed in Sidor et al. U.S. Pat. No. 3,988,710.

In carrying out the invention the potentiometer 70 is mounted in the lower portion 32 of the arm. Mounted upon the shaft 71 of the potentiometer is a gear 80 while mounted at the lower end of the plunger, which is in the upper portion 31 of the arm, are alternatively engageable racks 81, 82. The racks 81, 82 are spaced on opposite sides of the gear and are swingable through a small arc upon taking up the lost motion between the upper and lower portions of the arm 31, 32 so that either one rack or the other is engaged with the gear, thereby determining the polarity of the output signal. In the present instance the racks 81, 82 are mounted on opposite sides of a carrier 85 of picture frame shape having sides 86, 87 interconnected at the top by a cross member 88 into which the plunger 50 is tightly screwed and interconnected at the bottom by a lower cross member 89.

For the purpose of establishing a neutral, or angularly centered, position for the gear 80, a pair of set screws 91, 92 are screwed into the lower cross member of the carrier for reception in notches 93, 94, respectively, formed in the downwardly facing side of the gear 80. In the absence of squeezing force applied to the levers the return spring 52 exerts upward bias against the plunger 50 and hence upon the carrier 85, which is secured to the lower end of it, causing the tips of the set screws to seat in the notches 93, 94 positively locating the gear, and hence the potentiometer, in its central, or neutral, condition. To insure that the carrier 85 is precisely centered with respect to the lower portion 32 of the arm in its normal, or neutral, state, a detent is interposed. Such detent is in the form of roller 95 pinned to the lower portion of the arm cooperating with a notch 96 formed in the lower cross member 89 of the carrier, with the corners of the notch bottoming on the roller when the squeezing force on the levers is released.

To rotate the gear, and slider of the potentiometer, out of the neutral condition in one direction or the other to produce an output signal, a selected one of the racks is swung laterally into meshing engagement with the gear followed by downward movement of the plunger 50, and the engaged rack, to rotate the gear, and potentiometer slider, through an arc which is proportional to plunger displacement, i.e., to the degree of squeeze.

In order to insure that rack pre-selection precedes any downward movement of the plunger, a blocking member is interposed in the path of movement of the carrier 85. Such blocking member is in the form of a pin 100 which projects forwardly and backwardly from the carrier 85. Arranged in the path of downward movement of the ends of the pin are stops 101, 102 formed in the respective side plates 61, 62 which make up the lower portion of the arm.

Adjacent the stop members are pin-receiving slots 103, 104 which enable the pin to bypass the stops 101, 102 as long as the carrier is in a laterally displaced position. Thus the stops 101, 102 which prevent downward movement are effectively by-passed by taking up the lost motion between the upper and lower portions of the arm in one direction or the other. Stated in other words, the carrier is free to move downwardly and to rotate the potentiometer gear as long as pre-selection has been made and as long as the gear is in mesh with one of the racks. The stops 101, 102 have such width as to insure that the pre-selected rack remains in engagement with the gear throughout the stroke of the plunger and until the plunger is restored to its upper position. When squeezing force is released allowing the plunger to move upwardly, the pin 100 will move into the upper end of groove 103 or 104 which it occupies until it clears the stops 101, 102, at which time the pin will re-assume the illustrated initially blocked position illustrated in FIG. 2. The lateral throw of the pin 100, indicated at t, and which is substantially equal to the width of the slots 103, 104 determines the amount of angular lost motion in one direction from neutral about the upper hinge 66 which connects the upper and lower portions of the arm together.

Figure 5:
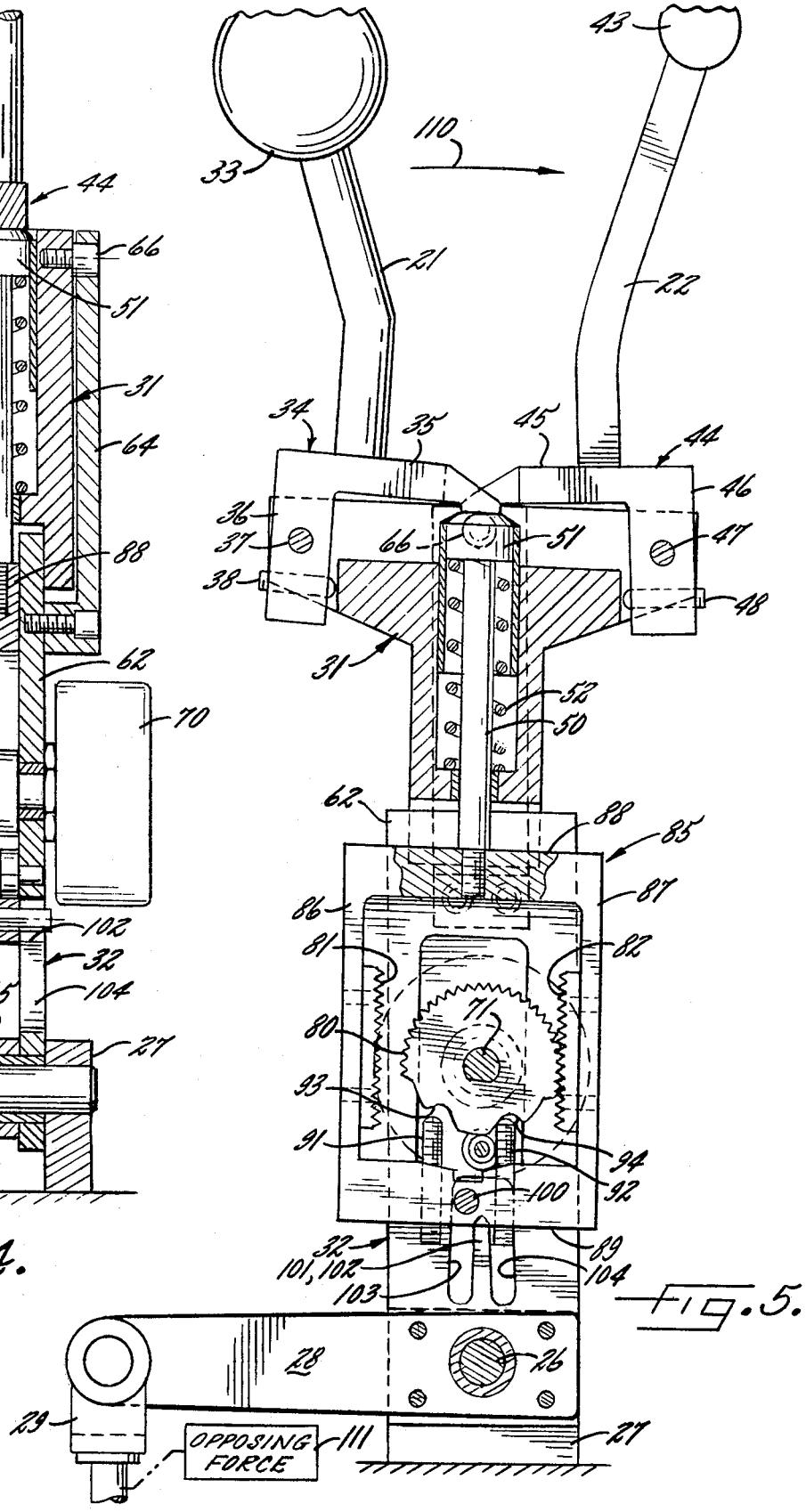
FIG. 5 is a view similar to FIG. 2 showing pre-selection of the polarity of the squeeze output signal.
Figure 6:
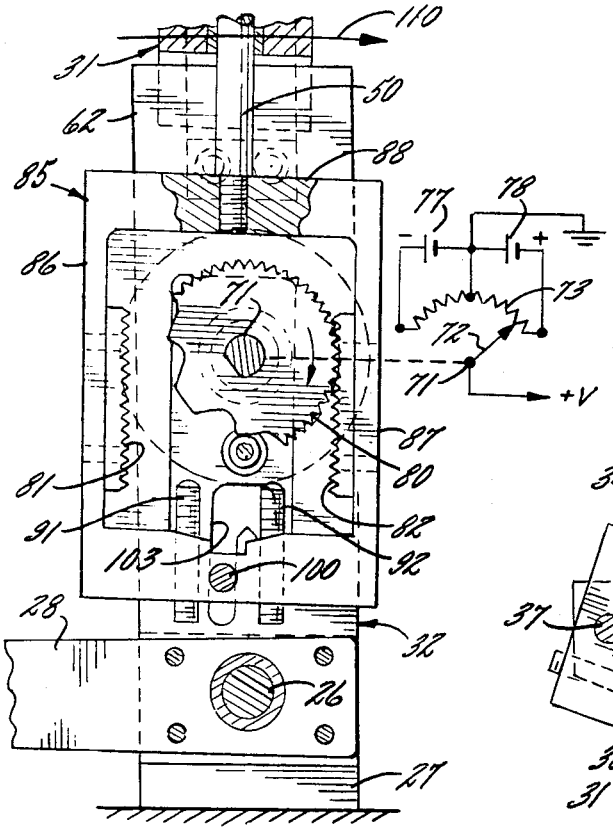
FIG. 6 is a fragmentary view, based upon FIG. 5, showing the output gear under conditions of maximum squeeze.

With the above construction in mind, attention may now be given to FIGS. 5 and 6 which show operation of the squeeze control in the forward or "positive polarity" mode. To pre-select positive polarity for the output signal both of the hand grips 21, 22, grasped by the hand, are rocked together in the forward direction (arrow 110) through a small angle to take up angular lost motion and until the pin 100 moves out of alignment with the blocking elements 101, 102 and into alignment with the slot 103. The taking up of lost motion brings rack 82 into mesh with the gear 80, thereby coupling the hand grips, through the plunger, to the potentiometer. Subsequent squeezing of the levers together into the dot-dash position thrusts the plunger 50, and the carrier 85 which is connected to it, downwardly into the position shown in FIG. 6 which produces clockwise rotation of the wiper 72 of the potentiometer resulting in a progressively positive voltage on the output terminal. The level of control voltage anywhere between zero and maximum positive may be precisely controlled by the degree of squeeze which is applied. It should be noted, however, that once pre-selection has occurred, that is to say, once the pin 100 is committed to the "positive" slot 103, the operator cannot change the polarity without releasing the squeeze and going back to the zero squeeze condition illustrated in FIG. 2. This protects the controlled device from abrupt changes in the control signal.

The taking up of the lost motion illustrated in FIG. 5 assumes that the lower portion 32 of the arm will remain stationary so that the upper portion may rock with respect to it. This condition is met by existence of normal friction in the lower linkage 29 resulting in the opposing force which is diagrammatically indicated at 111.

Suppose that with a given positive output signal it is now desired to reverse the operation of the controlled device by applying a negative output signal. To accomplish this, squeezing force is released to restore the condition of FIG. 2 to restore lost motion capability. Release of the hand grips results in return movement of the slider, unmeshing of the gear, and automatic centering of the gear by the set screws 91, 92. The hand grips 21, 22 are then rocked together in the opposite direction (arrow 112 in FIG. 7) to bring the rack 81 into engagement with the gear 80, which takes up lost motion and aligns pin 100 with the opposite slot 104 (see FIG. 7). Subsequent squeezing of the hand grips into the condition shown in FIG. 8 causes the rack 81 to be thrust downwardly rotating the gear 80 counterclockwise. The resultant motion of the wiper 72 of the potentiometer results in a negative voltage at the output terminal, the magnitude of the voltage depending upon the degree of squeeze. When the squeeze is released, the pin 100 travels upwardly out of the slot 104 back to its neutral position shown in FIG. 2 accompanied by return, unmeshing and centering of the gear 80.

In accordance with one of the more detailed aspects of the present invention, polarity selection, that is, the rocking of a predetermined one of the racks into mesh with the ear 80, is accompanied by "pre-advancement" of the signal-producing means, in the present instance the potentiometer 70, to produce a slight output signal in the direction of selected polarity. More specifically, means are provided for causing the take-up of a lost motion between the upper and lower portions 31, 32 of the arm to produce a slight amount of pre-rotation of the wiper of the potentiometer. In the present instance, this is brought about by utilizing the relative lateral motion which occurs between one of the centering screws 91, 92 and the gear 80 as the lost motion is taken up. This will be made clear by comparing FIG. 2, which shows the effect of polarity selection, in this case positive polarity. Thus, it will be noted in FIG. 5 that rocking the upper portion of the arm in the direction of the arrow 110 to bring the rack 82 into mesh with the gear 80 also serves to swing the centering set screw 92, which is in the notch 94 of the gear, to the left, resulting in rotation of the potentiometer shaft 71 through a slight angle which has been indicated at $\alpha$. This results in a slight positive output signal which exists on the output line before application of progressive squeezing force to the levers. By "slight" is meant small with respect to the total range of available output signal.

The small output signal which results from pre-selection of polarity is of particular advantage where the output signal is utilized to control an hydraulic valve of the solenoid type. Such valves are customarily made with a narrow "dead band" which results from the distance, from neutral, that the spool must move to remove the overlap between the valve surfaces and to achieve a position where the valve spool begins to open the valve port. The small output signal upon polarity selection is produced automatically, without requiring any intentional act on the part of the operator, to pre-advance the valve spool and therefore effectively eliminating the dead band; as a result, the valve produces fluid flow promptly as squeezing pressure is applied to the hand grips 21, 22. In short, the present control, by its pre-advancement feature, overcomes a handicap which commonly exists in hydraulic control valves to achieve a more precise and sensitive control free of any "dead" region about the neutral point.

Figure 7:
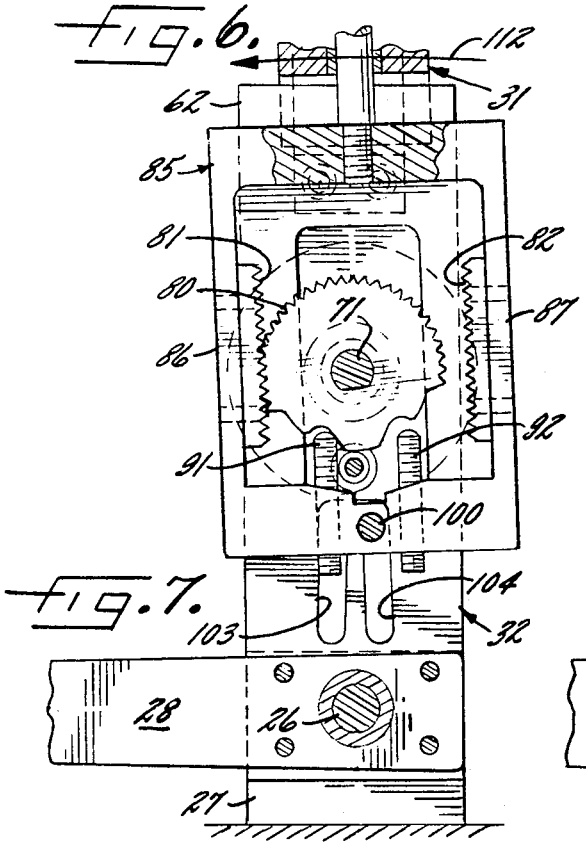
FIG. 7 is a fragmentary view based upon FIG. 2 but showing pre-selection of opposite polarity.
Figure 8:
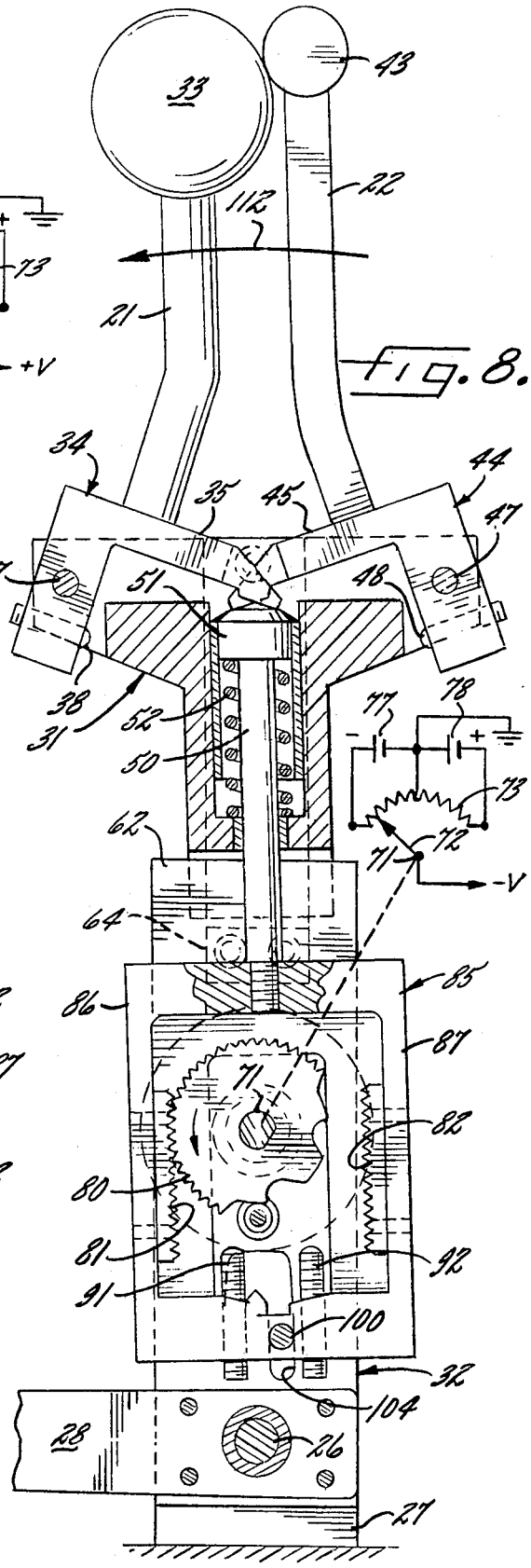
FIG. 8 shows an extension of the squeezing action of FIG. 7.

While the feature of pre-advancement has been discussed for selection of positive polarity, it will be understood that it works in an analogous way upon selection of negative polarity, as will be made clear upon comparing FIG. 2 with FIG. 7 where the centering set screw 91 is effective to pre-rotate the potentiometer slightly in the opposite direction.

In those applications where pre-advancement of the output signal is not required or desired, the notches 93, 94 may be disensed with and a "flat" substituted on the lower surface of the gear so that the gear remains in its centered position notwithstanding the lateral movement of one of the racks in the meshing direction. Alternatively, a small amount of intentional dead band may be incorporated at the central portion of the resistance element 73 of the potentiometer.

The above discussion of squeeze control has assumed that the lower portion 32 of the control arm remains stationary in its vertical position by reason of frictional or other opposing force in the linkage, resulting in a zero control arm output signal. It is, however, one of the primary features of the invention that the arm 25 may be bodily rocked by the same hand which provides the squeeze but independently of the degree of squeeze, in either one direction or the other about the arm axis 26 to produce a control signal of either sense, or polarity, and of any selected magnitude. Thus, in general, first and second output signals of selected priority and desired magnitude will be produced simultaneously by the operator's control of the position of his hand and the degree of squeeze provided by that hand, with the polarity of the squeeze signal being pre-selected by an initial auxiliary motion of the hand. This obviously requires a degree of practice and coordination but it is found that the two motions, squeeze and hand location, are natural motions which may be easily mastered and which become automatic with just a little practice.

The above configuration of manual dual function control utilizes three motions which all take place about significant axes tranverse to the position of the operator. These axes are, in order (FIG. 2), the lever axis 37, (or 47), the pre-select or lost motion axis 66 and the arm axis 26. Such triply transverse axes may be referred to, for convenience, as T-T-T.

Figure 9:
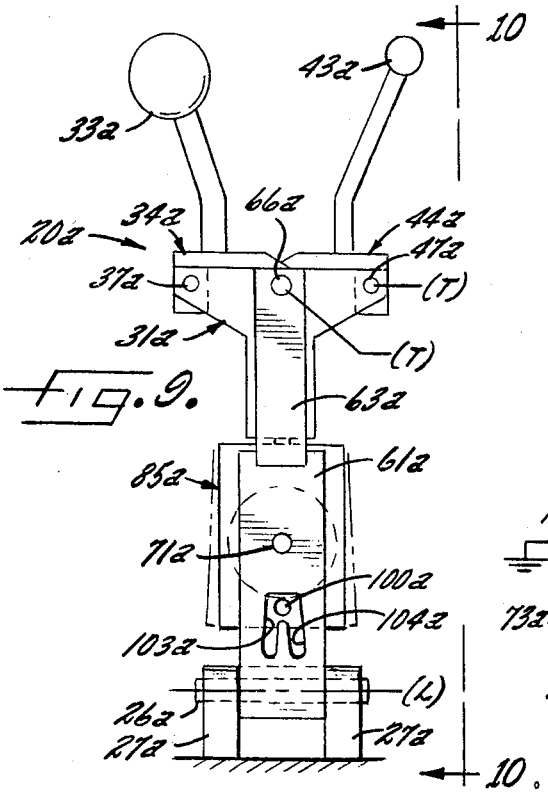
FIG. 9 shows a still further modification similar to FIG. 2 but with the main axis of the arm rotated at 90 degrees.
Figure 10:
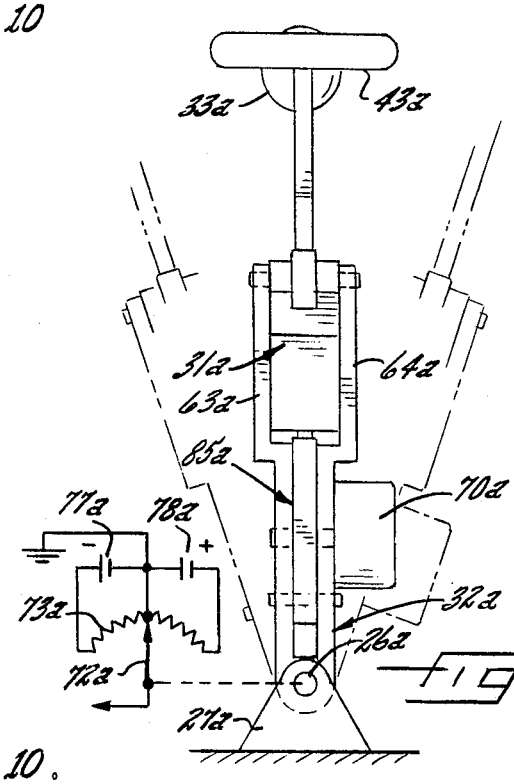
FIG. 10 is a view looking along line 10—10 in FIG. 9.

In the modified form of the invention illustrated in FIGS. 9 and 10, where similar elements are designated by similar reference numerals with addition of subscript a, the arm axis **26*a* is rotated at 90 degrees with respect to the axis 26 of the original embodiment shown, for example, in FIG. 2. In other words, the only change made in the embodiment of FIGS. 9 and 10** is that the lower, or arm, axis instead of being transversely related to the operator's position is now longitudinal, that is, "L" instead of "T", so that this embodiment may be referred to for convenience as T-T-L. As a result, the second control signal is produced by rocking the arm from left to right rather than forwardly and backwardly, but the squeeze and pre-selection continues to be in the forward and backward direction. One advantage of this arrangement is that pre-selection of squeeze polarity is completely divorced from the second control function.

Figure 11:
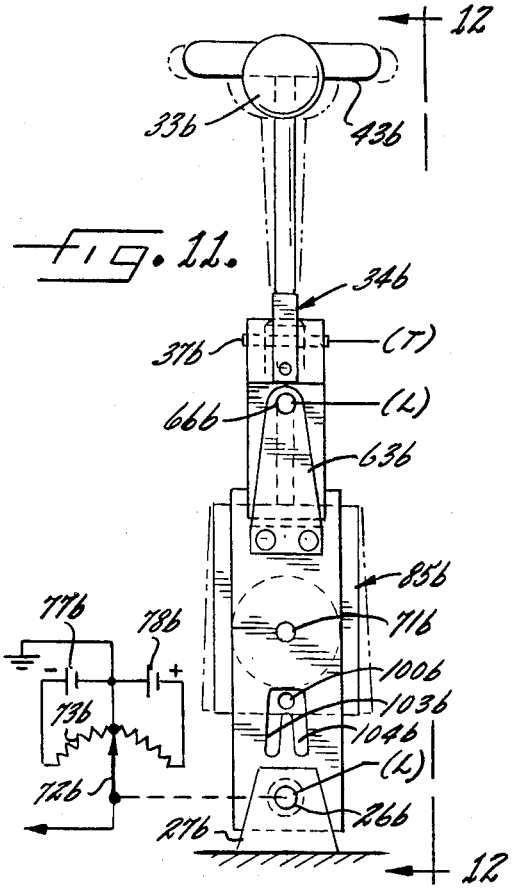
FIG. 11 shows a modification of the invention in which the auxiliary hand movement required for pre-selection is at right angles to that in the preceding figures.
Figure 12:
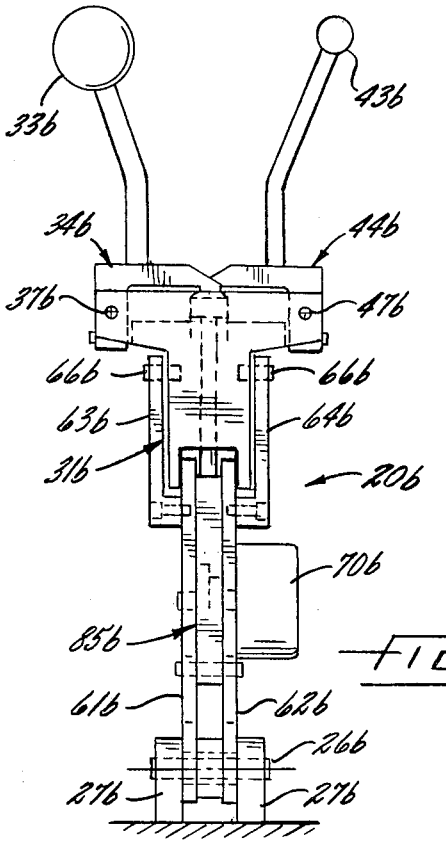
FIG. 12 is a view looking along line 12—12 in FIG. 11.

A further embodiment of the invention is illustrated in FIGS. 11 and 12 where reference numerals corresponding to the original embodiment have been used with addition of subscript b. This version differs from the original embodiment, shown in FIGS. 1 and 2, in only one respect and that is that the direction of the pivot axes of the hand grips have been rotated 90 degrees in a horizontal plane with respect to the remainder of the structure. Employing the above convention for labeling the axial directions, and maintaining a lever axis as a reference, the lever axis remains traverse (T), the pre-select axis becomes longitudinal (L) and the axis at the bottom of the arm, used for the second control function, is also longitudinal (L), the configuration thereby becoming T-L-L. In use, with the squeeze hand grips moving in forward and back relation, preselection is achieved by moving the hand grips, together, to one side or the other. The control of the second function by bodily swinging the arm 25 takes place in the same direction, that is, from side to side, just as in the case of the embodiment of FIGS. 9 and 10. A T-L-T relation is also possible.

Figure 13:
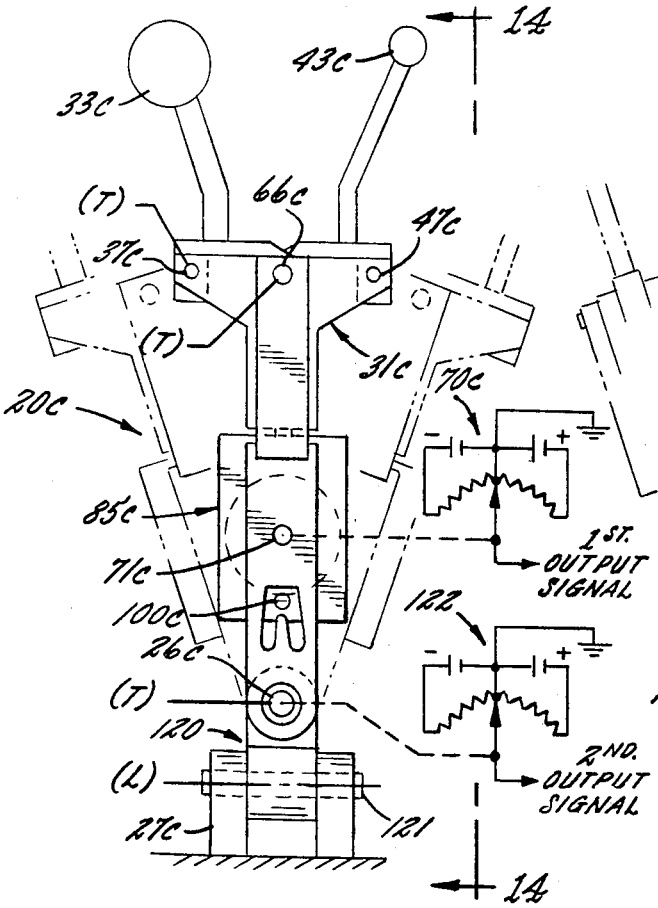
FIG. 13 is a still further modification similar to that shown in FIG. 2 but showing a universal joint at the point of connection of the arm enabling simultaneous control of a total of three different functions.
Figure 14:
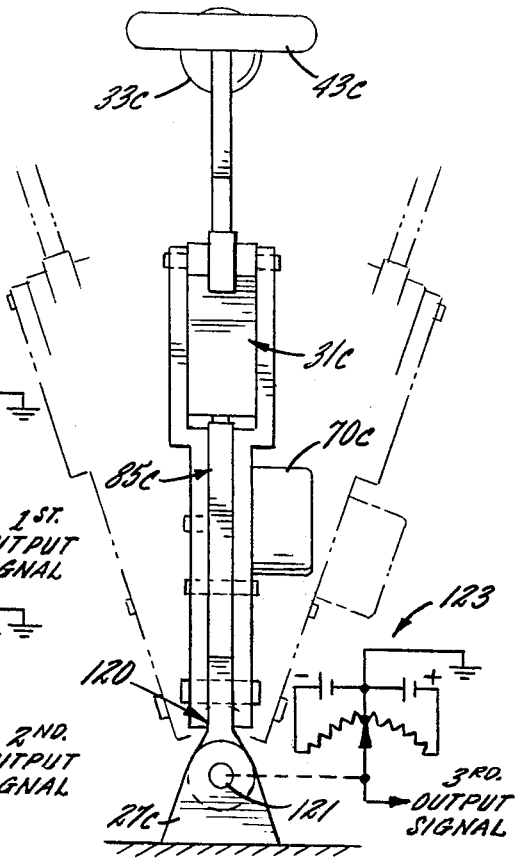
FIG. 14 is a view looking along line 14—14 in FIG. 13.
Figure 15:
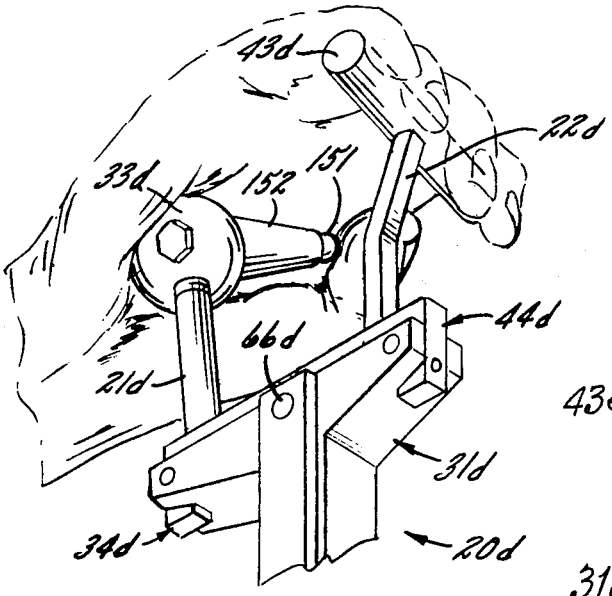
FIG. 15 is a perspective view showing the upper portion of the control arm equipped with a switch for polarity selection purposes.

It is one of the features of the present invention that the controller is not limited to production of two control signals but may be extended to produce a total of three control signals by use of a universal joint having rectangularly related axes at the lower end of the arm. This is shown in the embodiment illustrated in FIGS. 13 and 14 where similar reference numerals have been used to indicate similar parts with addition of subscript c. This embodiment corresponds to that illustrated in FIGS. 1 and 2, with the addition of a universal joint 120 having a first axis 26*c*, to which the arm 25*c* is secured and which is oriented in the "T" direction as well as a second axis 121 connected to the mount 27*c* and which is oriented in the "L" direction. This results in a T-T-T-L configuration. For the sake of convenience, means have been shown in FIG. 13 for achieving second and third control signals which are electrical in nature by coupling potentiometers indicated as 122, 123 for response to relative motion about the axes 26*c* and 121 respectively. As a result, three output signals may be economically achieved, the first resulting from squeezing action, the second from fore-and-back rocking of the control arm 25*c*, and a third as a result of swinging the control arm to the left and right from upright position. The simultaneous control of three functions by the same hand of the operator naturally requires a higher level of skill but experience has shown that the motions are natural and can be easily mastered. Examples of applications in which simultaneous control of three functions may be used with advantage include a bridge crane where a load, while being raised or lowered, may be moved longitudinally and transversely to save time in transport to a particular destination.

In accordance with one of the aspects of the present invention, instead of employing an initial rocking movement of the hand to pre-select the polarity of the squeeze control signal, pre-selection may be accomplished electrically by means of an auxiliary digitally operated switch as shown in FIGS. 15–18. In these views reference numerals have been employed, where applicable, which are the same as applied in the preceding views with addition of subscript d.

Figure 16:
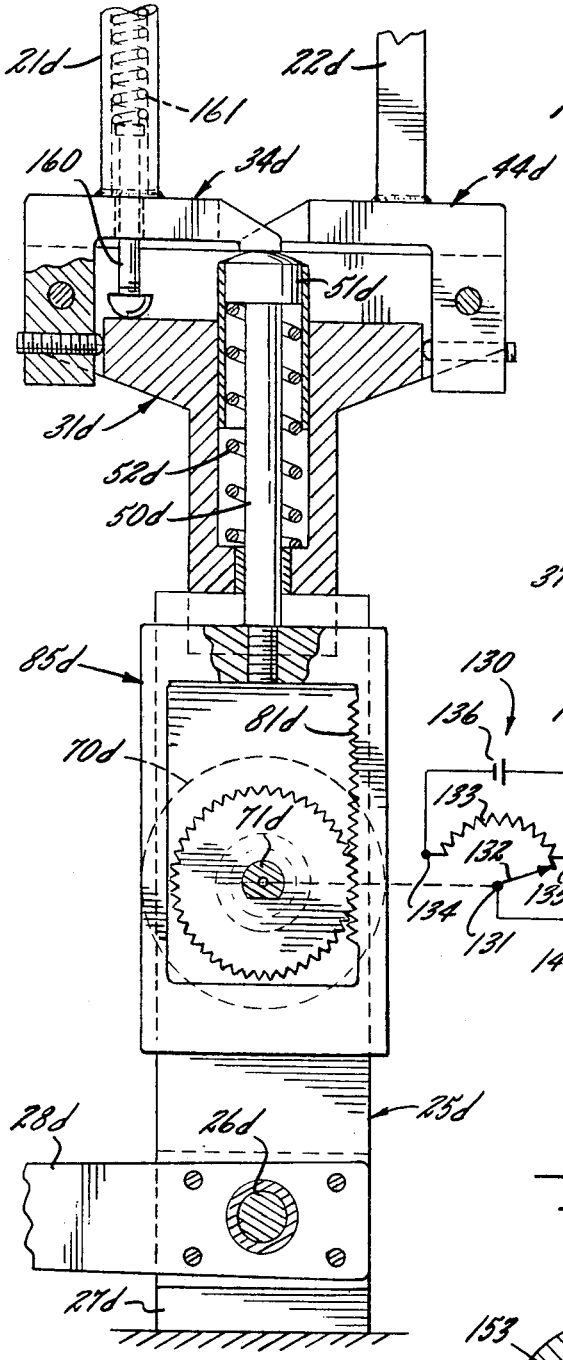
FIG. 16 shows the construction of the arm corresponding to FIG. 15 with an associated signal producing circuit.

Referring especially to FIG. 16, this embodiment employs a pair of hand grips 21*d*, 22*d* on bases 34*d*, 44*d* which are pivoted to a control arm 25*d* hinged at 26*d* upon a mount 27*d*. The physical structure is simplified in that a unitary arm 25*d* is used having no provision for lost motion for polarity selection purposes. Instead, the rack 81*d* in the carrier 85*d* which is fixed to the lower end of the plunger 50*d* is in permanent mesh with the gear 80*d* which rotates the potentiometer 70*d*.

The potentiometer circuit differs from that described above in that it includes a single source of polarity and has a switch which is digitally operated to reverse the polarity for pre-selection of the polarity of the output signal. The circuit, indicated at 130, includes a potentiometer having a shaft 131 carrying a wiper 132 riding on a resistance element 133 having end terminals 134, 135 bridged by a source of voltage 136. The output of the potentiometer is connected to a reversing switch 140 having movable blades 141, 142, each of which performs a double-throw function. The switch includes a plunger 143 which is outwardly biased by a spring 144. When the plunger is in its released state, the voltage at the output of blade 141 is positive whereas when the plunger 143 is depressed the signal voltage is of opposite, or negative, polarity.

Figure 17:
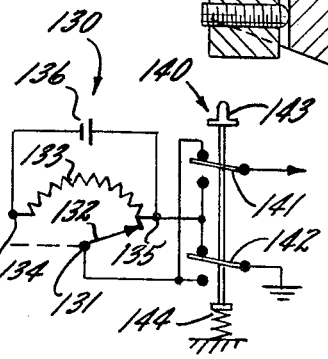
FIG. 17 is a cross sectional view taken through one of the hand grips.
Figure 17:
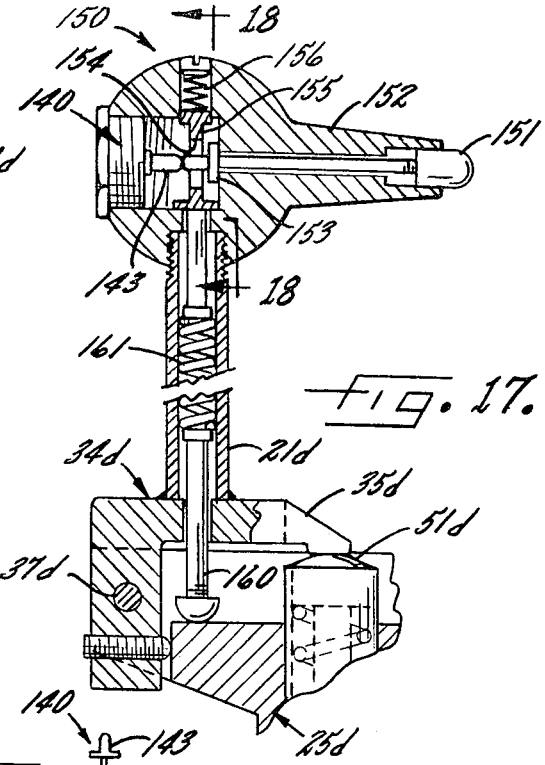
Figure 18:
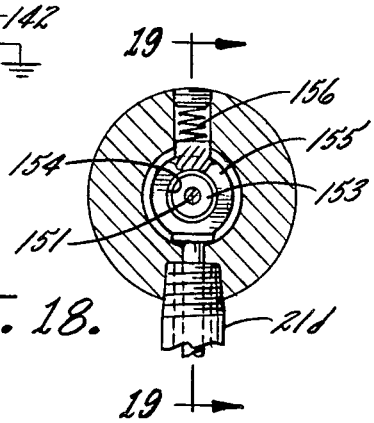
FIG. 18 is a fragmentary cross section taken along line 18—18 in FIG. 17.

In carrying out the invention the switch 140 is incorporated into one of the hand grips 21*d*, 22*d*. Preferably the switch is incorporated in the pad or ball 33*d* of the hand grip 21*d* as shown in FIG. 17. In this embodiment the switch 140 is operated by the thumb with an interlock 150 to permit the switch to be thrown only when the hand grip 21*d* is in its released state. The switch operating linkage includes a thumb operated plunger 151 which is telescoped into a stem 152 on the ball and which is aligned with the switch plunger 143 of the switch 140. The plunger 151 carries a disc 153 at its inner end which normally registers with a window 154 formed in a shiftable window member, or shutter, 155. The shutter 155, as shown in FIG. 18, is pressed downwardly into a normal seated position by coil spring 156.

Means are provided for raising the shutter into a blocking position with respect to the disc 153 on plunger 151 whenever the hand grip 21*d* is squeezed, that is, whenever the hand grip is rocked with respect to its normal upstanding position. To detect the rocked state of the grip 21*d* a detecting plunger 160 is telescoped into the arm 21*d* with its lower end seated against the upper end of the control arm 25*d*. A stiff coil spring 161 is interposed between the plunger 160 and the shutter 155, the spring 161 having a substantially higher spring rate than the shutter return spring 156. Thus when the hand grip 21*d* is squeezed, forcing the detector plunger 160 against the spring 161, motion is transmitted through the spring to move the shutter upwardly against the force of its return spring 156 so that the opening 154 of the shutter is out of register with the disc 153. Any overtravel of the plunger is accommodated by compression of the spring 161.

Thus in the event that the hand grip is squeezed before the thumb operated switch plunger 151 is depressed, the shutter insures that the switch 140 will be maintained in its initial condition. That is to say, once the hand grip 21*d* has been squeezed it is no longer possible to throw the switch.

Figure 19:
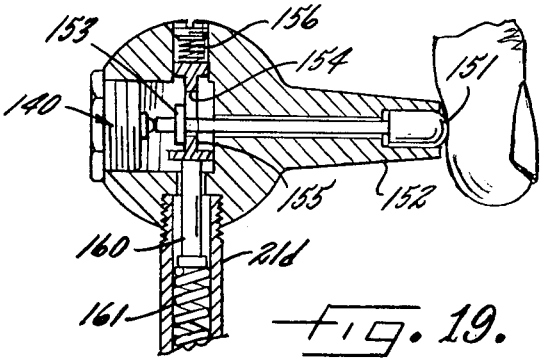
FIG. 19 is a fragmentary section taken along line 19*a*—19*a* in FIG. 18.

However, when it is desired to produce a squeeze control signal of opposite polarity, the opposite polarity is pre-selected by depressing the plunger 151 before squeezing pressure is applied. This causes the disc 153 to pass through the window 154 in the shutter depressing the plunger 143 of the switch 140 to throw the switch into its negative output condition. Subsequent application of squeezing force on the hand grip 21*d* causes the detector plunger 160 to crowd upwardly against the spring 161, moving the shutter 155 upwardly out of register with the disc 153, as shown in FIG. 19, which holds the reversing switch 140 in its thrown, or negative, state as long as squeezing force continues to be applied. Subsequent release of the squeezing force upon hand grip 21*d* releases the motion-transmitting spring 161 so that the shutter 155 is free to move under the force of its return spring 156 to restore the window 154 therein into a condition of register, thereby permitting the disc 153 to snap through the window back to its normal position and permitting the reversing switch 140 to revert, under the force of spring 144, to its normal state illustrated in FIG. 17.

The switch and interlock structure has been described in connection with a projection or stem on the ball which extends substantially at right angles to the hand grip so that the switch plunger 151 and interlock plunger 160 are in intersecting relation. In a practical case it may be desirable to angle the stem 152 downwardly from a horizontal position by 30 degrees or so while keeping the switch and interlock mechanism the same. This can be accomplished by forming the stem 152 and its central passageway in a downwardly-curved shape and by making the plunger 150, or at least a portion thereof, in the form of a stiff yet flexible cable, sufficiently flexible to accommodate itself to the curvature of the passageway through which it extends.

In the above description of the various embodiments the control arm 25 has been assumed to have a normal vertical orientation and hence the terms "upper" and "lower" have been used to relate the parts. It will be understood, however, that these terms are relative and that the arm may have any desired orientation without affecting its features and advantages. Similarly the term "hand grip" has been used for convenience in describing the hand levers 21, 22. In the first embodiment it is desired that both of these hand grips be pivoted about parallel axes as shown since the forces developed by the hand grips against the plunger return spring are additive. However, it will be understood that the invention is not limited to pivoting of both of the hand grips and that pivoting of one of them suffices for control purposes with the other remaining fixed to the upper portion of the arm 25 as a reference. Indeed, one skilled in the art will appreciate that in order to practice the invention the hand grips need not be pivoted at all just as long as they are so mounted that squeezing them together results in a corresponding displacement of the central plunger; for example, the lower end of at least one of the hand grips may be slideably mounted, with a cam for bringing pressure to bear against the end of the plunger as the hand grips are squeezed toward one another.

Figure 20:
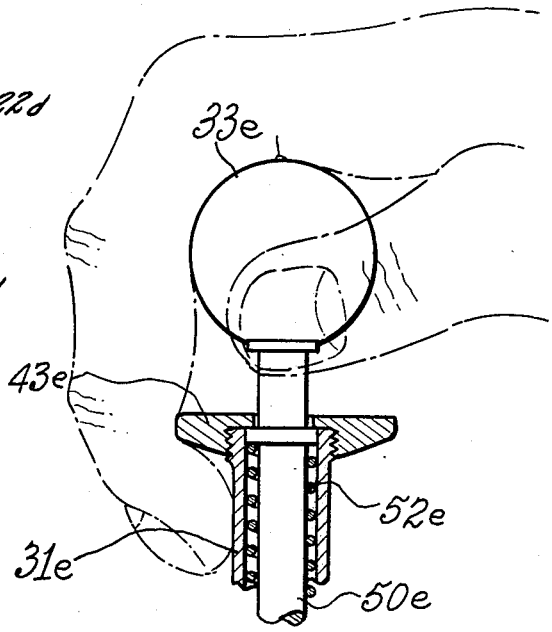
FIG. 20 shows simplified structure for applying squeezing force for less demanding applications.

It is found that where the control function being performed requires control with a high degree of precision the palm-rest on one of the squeezed elements and the finger grip on the other should be spaced so that the palm rest seats at the base of the palm thereby enabling use, for control purposes, of the grasping motion of the entire hand. Where the application is such as to require a less precise degree of control the squeezing action of the fingers alone may suffice, with the palm rest being seated in the forepart of the palm rather than at the base of the palm and with relative motion being achieved by the curling action of the index and middle fingers. This permits simplification of the structure as illustrated in FIG. 20. Here the upper portion of the control arm indicated at 31*e* carries a plunger 50*e* having a return spring 52*e*. The upper end of the plunger carries a hand grip in the form of a palm-rest 33*e* which may be conveniently shaped as a ball for engaging the forepart of the palm. The upper end of arm 31*e* has, threaded or otherwise secured to it, a second hand grip or finger grip 43*e* which may, for example, be of annular shape, projecting laterally a sufficient distance so as to be engaged by the fingertips as shown. Such an arrangement has the advantage that fewer parts are required and the plunger is directly, rather than indirectly actuated. For the purpose of reading the claims on the structure illustrated in FIG. 20 the members 33*e*, 43*e* may each be considered within the scope of the term "hand grip" as that term is broadly defined, and the presented surfaces of such members respectively engagable by the palm and fingertips may be considered as "pads".

It will be apparent to one skilled in the art that the upper portion of the structure shown in the preceding figures may be substituted by that illustrated in FIG. 20 without modification of the remaining structure or its features and advantages, the only sacrifice being in the degree of precision of the control which is achieved.

As described above, each of the hand grips is provided with a "pad" which is appropriately shaped to engage a portion of the hand of the operator. In the particular embodiment shown, one pad is in the form of a ball 33, for fitting comfortably in the palm, while the other pad is in the form of a transverse finger grip 43. The invention, however, is not limited to pads of this shape and the term shall be understood to apply to any surfaces intended to be squeezed by portions of the operator's hand.

The term "plunger" has been used to aptly describe the push-rod element 50 in the illustrated embodiments. However, it will, again, be understood by one skilled in the art that the invention is not limited to use of a push-rod for coupling the hand grips to the signal producing element and that any desired type of linkage or connector may be substituted for accomplishing the intended purpose; accordingly, the term "plunger" is defined simply as a motion transmitting element for transmitting motion from the hand grips to the device, in the present instance a potentiometer, which produces the output signal.

The plunger 50 in the present construction is stated to have an associated return spring 52 which is, in the present instance, conveniently telescoped over the plunger. However, it will be appreciated that in performing its return function the spring need not directly engage the plunger but may be anywhere in the mechanical system which includes the plunger; for example, the return spring may be mounted under the carrier 85 for the purpose of biasing it upwardly relative to the remainder of the structure. Or the return spring may be associated directly with the hand grips to resist the squeezing force.

The use of toothed surfaces on the racks and gear has the advantage that engagement and displacement occur positively, free of any possibility of slippage. However, the terms "gear" and "rack", it will be understood, are not limited to use of teeth which mesh together, and, since the loading is light, the engaging surfaces may be frictional in nature.

It has already been pointed out that the term "output signal" is not limited to an electrical output signal. Moreover, where an electrical output signal is used the term "polarity" is not related, necessarily, to a reference voltage of zero, as here, but the reference may be at any desired level. For example, where a simple three-terminal form of potentiometer is used having a voltage of, say, ten volts across its outer terminals, it will be convenient to use a reference voltage of five volts to represent the neutral condition, with the signal voltages being measured plus or minus with reference to that level.

I claim as my invention:

1. In a control system, a squeeze type manual controller comprising, in combination, a control arm, a mount providing a movable connection therefor, a pair of hand grips extending longitudinally from the upper end of the arm, the hand grips being pivoted to the arm for rocking movement about parallel axes, the hand grips having respective pads at their outer ends and having a normal spacing in which the pads are engageable by the palm and fingertips of one hand, a central plunger mounted for reciprocating movement in said arm and having a return spring, means for coupling both of the hand grips to the plunger so that squeezing of the hand grips together causes the plunger to move downwardly against the force of the return spring, means at the lower end of the plunger and coupled thereto for producing a first output signal in accordance with plunger displacement, and means for producing a second output signal in accordance with the displacement of the arm with respect to the movable connection.

2. In a contral system, a squeeze type manual controller comprising, in combination, a control arm, a mount therefor, a pair of hand grips extending from the upper end of the arm, at least one of the hand grips being mounted on the arm for movement toward and away from the other hand grips, the hand grips having respective gripping pads and having a normal spacing in which the pads are respectively engageable by the palm and fingertips of one hand of the operator, a plunger mounted for reciprocating movement in said arm and having a return spring, means for coupling the movable hand grips to the plunger so that squeezing of the hand grips together causes the plunger to move against the force of the return spring, means coupled to the plunger for producing an output signal of selected polarity and which varies in accordance with plunger displacement, and means responsive to an auxiliary movement of the hand of the operator and coupled to the output signal means for preselecting the polarity of the output signal.

3. In a control system, a squeeze type manual controller comprising, in combination, a control arm, a mount therefor, a pair of hand grips extending from the upper end of the arm, at least one of the hand grips being mounted on the arm for movement toward and away from the other hand grip, the hand grips having respective gripping pads and having a normal spacing in which the pads are respectively engageable by the palm and fingertips of one hand of the operator, a plunger mounted for movement in said arm and having a return spring, means for coupling the movable hand grip to the plunger so that squeezing of the hand grips together causes the plunger to move against the force of the return spring, means coupled to the plunger for producing an output signal of preselected polarity and which varies in accordance with plunger displacement, the arm having upper and lower sections having limited lost motion between them in opposite directions, and means responsive to the direction of the relative movement between the sections for preselecting the polarity of the output signal.

4. In a control system, a squeeze type manual controller comprising, in combination, a control arm, a mount therefor, a pair of hand grips extending from the upper end of the arm, at least one of the hand grips being mounted on the arm for movement toward and away from the other hand grip, the hand grips having respective gripping pads and having a normal spacing in which the pads are respectively engageable by the palm and fingertips of one hand of the operator, a plunger in the arm having a return spring, means for coupling the movable hand grips to the plunger so that squeezing of the hand grips together causes the plunger to move against the force of the return spring, means coupled to the plunger for producing an output signal of preselected polarity and which varies in accordance with plunger displacement, a main hinge connection at the lower end of the arm for enabling bodily rocking of the arm and an auxiliary hinge connection having limited articulation in opposite directions interposed in the central portion of the arm, and means responsive to the direction of articulating movement at the auxiliary hinge connection for preselecting the polarity of the output signal.

5. A combination as claimed in claim 4 in which the main and auxiliary hinge connections are disposed at right angles to one another.

6. In a control system, a squeeze type manual controller comprising, in combination, a control arm, a mount therefor, a pair of hand grips extending from the upper end of the arm, at least one of the hand grips being mounted on the arm for movement toward and away from the other hand grips, the hand grips having respective gripping pads and having a normal spacing in which the pads are respectively engageable by the palm and fingertips of one hand of the operator, a plunger mounted for movement in said arm and having a return spring, means for coupling the movable hand grip to the plunger so that squeezing of the hand grips together causes the plunger to move against the force of the return spring, means coupled to the plunger for producing an output signal of preselected polarity and which varies in accordance with plunger displacement, a main hinge connection at the lower end of the arm for bodily swinging movement of the arm, an auxiliary hinge connection having limited articulation in opposite directions incorporated in the central portion of the arm, means responsive to the direction of articulating movement for selecting the polarity of the output signal, the axes of the hinge connections being parallel to one another, and means at the main hinge connection for opposing the rocking movement of the arm so that force applied to the hand grips in an armrocking direction results initially in articulation at the second hinge connection.

7. In a control system, a squeeze type manual controller comprising, in combination, a control arm, a mount therefor, a pair of hand grips extending from the upper end of the arm, at least one of the hand grips being mounted on the arm for movement toward and away from the other hand grips, the hand grips having respective gripping pads and having a normal spacing in which the pads are respectively engageable by the palm and fingertips of the hand of the operator, a plunger in the arm having a return spring, means for coupling the movable hand grips to the plunger so that squeezing of the hand grips together causes the plunger to move against the force of the return spring, the arm having upper and lower portions interconnected by a lost motion connection, one of the portions having a gear mounted thereon and the other portion having opposed racks for alternative engagement with the gear so that one of the racks meshes with the gear as a result of force initially applied to the levers to take up the lost motion in one direction or the other, the plunger being so coupled to the gear and racks as to produce rotation of the gear in a corresponding direction after one of the racks is in meshing engagement, and means coupled to the gear for producing an output signal which has a polarity in accordance with which of the racks is engaged and which varies in magnitude in accordance with plunger displacement resulting from squeezing of the hand grips.

8. In a control system, a squeeze type manual controller comprising, in combination, a control arm, a mount therefor, a pair of hand grips extending from the upper end of the arm, at least one of the hand grips being pivoted to the arm for movement toward and away from the other hand grip, the hand grips having respective gripping pads having a normal spacing in which the pads are respectively engageable by the palm and fingertips of the hand of the operator, a plunger in the arm having a return spring, means for coupling the movable hand grips to the plunger so that squeezing of the hand grips together causes the plunger to move against the force of the return spring, the arm having upper and lower portions interconnected by a hinge connection, the lower portion having a gear journaled therein, a pair of racks spaced on opposite sides of the gear and connected to the upper portion of the arm remotely from the hinge so that a corresponding one of the racks meshes with the gear as the upper portion of the arm is rocked by the hand grips in one direction or the other, the plunger being coupled to the racks to produce rotation of the gear after one of the racks is meshed therewith, and a signal producing means coupled to the gear for producing an output signal which has a polarity in accordance with which of the racks is engaged and which varies in magnitude in accordance with the amount of plunger displacement resulting from the squeezing of the hand grips.

9. In a control system, a squeeze type manual controller comprising, in combination, a control arm, a mount therefor, a pair of hand grips extending from the upper end of the arm, at least one of the hand grips being mounted on the arm for movement toward and away from the other hand grip, the levers having respective gripping pads having a normal spacing in which the pads are respectively engageable by the palm and fingertips of the hand of the operator, a plunger in the arm having a return spring, means for coupling the movable hand grip to the plunger so that squeezing of the hand grips together causes the plunger to move against the force of the return spring, the arm having upper and lower portions interconnected by a hinge connection, the lower portion having a gear journaled therein, a pair of racks spaced on opposite sides of the gear and connected to the upper portion of the arm remotely from the hinge so that a corresponding one of the racks meshes with the gear as the upper portion of the arm is rocked by the levers in one direction or the other, the plunger being coupled to the racks to produce rotation of the gear after one of the racks is meshed therewith, and an electric signal producing means coupled to the gear for producing an electrical output signal which has a polarity in accordance with which of the racks is engaged and which varies in magnitude in accordance with the amount of plunger displacement resulting from the squeezing of the levers, and means for maintaining the selected rack in engagement over the stroke of the plunger until the plunger is restored to its initial condition by a release of squeezing force on the hand grips.

10. The combination as claimed in claim 2 or in claim 3 or in claim 4 or in claim 6 or in claim 7 or in claim 8 or in claim 9 in which both of the hand grips are movably mounted on the arm for acting simultaneously upon the plunger.

11. The combination as claimed in claim 1 or in claim 2 or in claim 3 or in claim 6 or in claim 7 or in claim 8 or in claim 9 in which the arm has a main hinge connection with the mount and in which means are provided at the main hinge connection for producing a second output signal in response to the relative movement between the arm and the mount.

12. The combination as claimed in claim 1 or in claim 2 or in claim 3 or in claim 6 or in claim 7 or in claim 8 or in claim 9 in which the arm has a main hinge connection with the mount and in which means are interposed between the arm and the mount for producing a second output signal having a polarity which depends upon the direction of rocking movement from a neutral position and having a magnitude which varies in accordance with the angular displacement of the arm with respect to the mount.

13. The combination as claimed in claim 1 or in claim 2 or in claim 3 or in claim 6 or in claim 7 or in claim 8 or in claim 9 in which means are provided for normally blocking the plunger and in which means are provided for disabling the blocking means upon preselection of the polarity of the output signal thereby to permit subsequent movement of the plunger to increase the magnitude of the output signal.

14. The combination as claimed in claim 7 or in claim 8 or in claim 9 which includes means responsive to the return movement of the plunger upon release of squeezing force for angularly centering the gear in a neutral position in readiness for subsequent actuation.

15. In a control system, a squeeze type manual controller comprisng, in combination, a control arm, a mount therefor, a pair of hand grip extending from the upper end of the arm, at least one of the hand grips being mounted on the arm for movement toward and away from the other hand grip, the hand grips having respective gripping pads and having a normal spacing in which the pads are respectively engageable by the palm and fingertips of one hand of the operator, a plunger mounted for movement in said arm and having a return spring, means for coupling the movable hand grip to the plunger so that squeezing of the hand grips together causes the plunger to move against the force of the return spring, means coupled to the plunger for producing a first output signal which varies in accordance with plunger displacement, a hinge connection between the arm and the mount, and means interposed between the arm and the mount for producing a second output signal which varies in accordance with the angular displacement of the arm with respect to the mount.

16. In a control system, a squeeze type manual controller comprising, in combination, a control arm, a mount therefor, a pair of hand grips extending from the upper end of the arm, at least one of the hand grips being mounted on the arm for movement toward and away from the other hand grip, the hand grips having respective gripping pads and having a normal spacing in which the pads are respectively engageable by the palm and fingertips of one hand of the operator, a plunger mounted for movement in said arm and having a return spring, means for coupling the movable hand grip to the plunger so that squeezing of the hand grips together causes the plunger to move against the force of the return spring, means coupled to the plunger for producing a first output signal which varies in accordance with plunger displacement, a universal joint between the arm and the mount providing relative movement of the arm about first and second axes at right angles to one another, means for producing a second output signal which varies in accordance with the angular displacement of the arm about the first axis and means for producing a third output signal which varies in accordance with the angular displacement of the arm about the second axis.

17. The combination as claimed in claim 2 in which the means responsive to an auxiliary movement of the hand of the operator is in the form of a double-throw switch coupled to the output signal means for preselecting the polarity of the output signal, and interlock means for blocking actuation of the switch when the plunger is in a displaced condition, the switch being placed for convenient digital actuation with the operator's hand in a grasping position.

18. In a control system, a squeeze type manual controller comprising, in combination, a control arm, a mount therefor, a pair of hand grips extending from the upper end of the arm, at least one of the hand grips being mounted on the arm for movement toward and away from the other hand grip, a return spring therefor, the hand grips having respective gripping pads and having a normal spacing in which the pads are respectively engageable by the palm and fingertips of one hand of the operator, signal producing means coupled to the movable hand grip so that squeezing of the hand grips together produces an output signal in accordance with the degree of squeeze, a reversing switch arranged for convenient digital operation by the hand of the operator prior to applying squeezing force, the reversing switch being coupled to the signal producing means for preselecting the polarity of the output signal, and interlock means for blocking actuation of the switch in either direction when the movable hand grip is in squeezed condition.

19. In a control system a squeeze type manual controller comprisng, in combination, a control arm, a mount therefor, a pair of hand grips extending from the upper end of the arm, at least one of the hand grips being mounted on the arm for movement toward and away from the other hand grip, the hand grips having respective gripping pads having a normal spacing in which the pads are engageable by the palm and fingertips of one hand, a spring coupled to the movable hand grip for resisting the squeezing force applied thereto, means including a potentiometer coupled to the movable hand grip for producing an output signal which varies in accordance with the degree of squeeze, a reversing switch on the movable hand grip positioned for convenient digital manipulation and having a released position and a pressed position, means for coupling the switch to the potentiometer to preselect the polarity of the output signal, and means including a mechanical interlock for blocking actuation of the switch in either direction when the movable hand grip is in the squeezed condition.

20. The combination as claimed in claim 18 or in claim 19 in which the hand grip which mounts the palm pad is movable and in which the switch is mounted in the palm pad, the palm pad having a stem projecting angularly therefrom, a switch plunger in the stem having a push button at the end thereof, the mechanical interlock including an interlock plunger in the palm hand grip and which engages the end of the arm so as to be responsive to movement of such hand grip, the two plungers being arranged intersectingly so that the switch plunger is freely movable when the interlock plunger is in a free state but so that the switch plunger is blocked against switching movement when the interlock plunger is displaced as a result of squeezing.

21. The combination as claimed in claim 17 or in claim 18 or in claim 19 in which the control arm is pivoted to the mount at its lower end for rocking movement thereabout, and means interposed between the arm and the mount for producing a second control signal variable in direction and magnitude in accordance with the direction and magnitude of the rocking movement.

22. In a control system, a squeeze type manual control for simultaneously controlling two separate control functions comprising, in combination, a control arm, a mount therefor, a pair of hand grips extending from the upper end of the arm, at least one of the hand grips being mounted in the arm for movement toward and away from the other hand grip, the hand grips having respective gripping pads and having a normal spacing in which the pads are grippingly engageable by the palm and fingertips of one hand of the operator for application of squeezing force, a return spring interposed between the arm and the movable hand grip for progressively resisting the squeezing force, means coupled to the movable hand grip for producing a first output signal which varies in magnitude in accordance with the degree of squeeze, polarity selector means responsive to an auxiliary movement of the hand of the operator with respect to the mount while the hand is in gripping position but prior to progressive application of squeezing force and coupled to the signal producing means for predetermining the polarity of the output signal, an interlock device having an element effectively interposed between the movable hand grip and the arm for preventing actuation of the selector means during the time that squeezing force is being applied while permitting actuation of the selector means when squeezing force is released thereby to insure that switching of polarity takes place only when the output signal is in neutral condition, the arm having a main hinge connection at its lower end for bodily rocking of the arm with respect to the mount by the gripping hand of the operator, and means coupled to the main hinge connection for producing a second output signal in accordance with the relative movement between the arm and the mount.

23. In a control system, a squeeze type manual control for simultaneously controlling two separate control functions comprising, in combination, a control arm, a mount therefor, a pair of hand grips extending from the upper end of the arm, at least one of the hand grips being mounted in the arm for movement toward and away from the other hand grip, the hand grips having respective gripping pads and having a normal spacing in which the pads are grippingly engageable by the palm and fingertips of one hand of the operator for application of squeezing force, a return spring interposed between the arm and the movable hand grip for progressively resisting the squeezing force, means coupled to the movable hand grip for producing a first output signal which varies in magnitude in accordance with the degree of squeeze, means for maintaining the first output signal means in a null position between respective positions of polarity in the absence of a squeeze, polarity selector means responsive to an auxiliary movement of the total hand of the operator with respect to the mount while the hand is in gripping position but prior to progressive application of squeezing force and coupled to the signal producing means for predetermining the polarity of the output signal, an interlock device having an element effectively interposed between the movable hand grip and the arm for preventing actuation of the selector means during the time that squeezing force is being applied while permitting actuation of the selector means from the null position when squeezing force is released thereby to insure that switching of polarity takes place only when the output signal is in null condition, the arm having a main hinge connection at its lower end for bodily rocking of the arm with respect to the mount by the gripping hand of the operator, and means coupled to the main hinge connection for producing a second output signal in accordance with the relative movement between the arm and the mount.

24. In a control system a squeeze type manual control comprising, in combination, a control arm, a mount therefor, a pair of hand grips extending from the upper end of the arm, at least one of the hand grips being mounted in the arm for movement toward and away from the other hand grip, the hand grips having respective gripping pads and having a normal spacing in which the pads are grippingly engageable by the palm and fingertips of one hand of the operator for applicaton of squeezing force, a return spring interposed between the arm and the movable hand grip for progressively resisting the squeezing force, means coupled to the movable hand grip for producing an output signal which varies in magnitude in accordance with the degree of squeeze, polarity selector means having opposite states and responsive to an auxiliary movement of the hand of the operator while the hand is in gripping position but prior to progressive application of squeezing force and coupled to the signal producing means for predetermining the polarity of the output signal, and interlock means for preventing actuation of the selector means between its opposite states during the time that squeezing force is being applied while permitting actuation of the selector means when the squeezing force is released thereby to insure that switching of polarity may take place only when the output signal is in neutral condition.

25. In a control system a squeeze type manual control comprising, in combination, a control arm, a mount therefor, a pair of hand grips extending from the upper end of the arm, at least one of the hand grips being mounted in the arm for movement toward and away from the other hand grips, the hand grips having respective gripping pads and having a normal spacing in which the pads are grippingly engageable by the palm and fingertips of one hand of the operator for application of squeezing force, a return spring interposed between the arm and movable hand grip for progressively resisting the squeezing force, means coupled to the movable hand grip for producing an output signal which varies in magnitude in accordance with the degree of squeeze, shiftable polarity selector means responsive to a bodily shifting movement of the hand of the operator in a predetermined direction while the hand is in gripping position but prior to progressive application of squeezing force and coupled to the signal producing means for predetermining the polarity at the output signal, and interlock means including an element effectively interposed between the movable hand grip and the arm for preventing the shifting movement during the time that squeezing force is being applied while permitting actuation of the selector means when the squeezing force is released, thereby to insure that switching of polarity may take place only when the output signal is in neutral condition.

26. In a control system a squeeze type manual control comprising, in combination, a control arm, a mount therefor, a pair of hand grips extending from the upper end of the arm, at least one of the hand grips being mounted in the arm for movement toward and away from the other hand grip, the hand grips having respective gripping pads and having a normal spacing in which the pads are grippingly engageable by the palm and fingertips of one hand of the operator for application of squeezing force, a return spring interposed between the arm and the movable hand grip for progressively resisting the squeezing force, means coupled to the movable hand grip for producing an output signal which varies in magnitude in accordance with the degree of squeeze, polarity selector means responsive to an auxiliary movement of the hand of the operator while the hand is in gripping position but prior to progressive application of squeezing force and coupled to the signal producing means for predetermining the polarity of the output signal, interlock means for preventing actuation of the selector means during the time that squeezing force is being applied while permitting actuation of the selector means when the squeezing force is released thereby to insure that switching of polarity may take place only when the output signal is in neutral condition, and pre-advancement means actuated by the polarity selector means for producing a small output signal of the selected polarity incident to making the selection.

27. The combination as claimed in claim 7 or claim 8 or claim 9 including means for pre-advancing the gear through a small angle incident to bringing one of the racks into meshing engagement with the gear and in an angular direction which corresponds to the selected polarity.

28. The combination as claimed in claim 4 or in claim 6 or in claim 8 or in claim 9 or in claim 24 in which the upper and lower portions of the arm have a detent effectively interposed between them for establishing a centered neutral condition.

29. The combination as claimed in claim 4 or in claim 6 or in claim 8 or in claim 9 in which the upper and lower portions of the arm have a detent effectively interposed between them for establishing a centered neutral condition, the detent being coupled to the plunger for release upon initial movement of the plunger resulting from squeezing the levers together.

* * * * *

UNITED STATES PATENT AND TRADEMARK OFFICE

CERTIFICATE OF CORRECTION

PATENT NO. : 4,332,177

DATED : June 1, 1982

INVENTOR(S) : Herman J. Andresen

It is certified that error appears in the above-identified patent and that said Letters Patent are hereby corrected as shown below:

Col. 3, line 34, delete "squeeze"

Col. 11, line 11, delete "levers" and insert --grips--

Col. 14, line 39, delete "grips" and insert --grip--

Col. 16, line 17, change "comprisng" to --comprising--.

Signed and Sealed this

*Fourteenth* Day of *December 1982*

[SEAL]

*Attest:*

GERALD J. MOSSINGHOFF

*Attesting Officer*

*Commissioner of Patents and Trademarks*